United States Patent [19]

Shatto, Jr.

[11] Patent Number: 4,633,710

[45] Date of Patent: Jan. 6, 1987

[54] SHIP WAVE HEADING INDICATION METHOD AND APPARATUS

[75] Inventor: Howard L. Shatto, Jr., Houston, Tex.

[73] Assignee: Shell Offshore, Inc., Houston, Tex.

[21] Appl. No.: 692,094

[22] Filed: Jan. 17, 1985

[51] Int. Cl.[4] ..... G01C 21/00

[52] U.S. Cl. ..... 73/178 R

[58] Field of Search ..... 73/178 R, 170 A; 114/144 B, 122, 124, 275

[56] References Cited

U.S. PATENT DOCUMENTS 2,202,162 5/1940 Minorsky ..... 114/122

3,407,767 10/1968 McClintock et al. ..... 114/122

*Primary Examiner*—Donald O. Woodieu

[57] ABSTRACT

Method and apparatus for use in a floating vessel subjected to wave action, used to determine the proper vessel heading so that the longitudinal axis of the vessel will be positioned parallel to the direction of oncoming waves, thereby reducing the risk of capsizing of the vessel. The apparatus comprises a mass elastically suspended from a portion of the vessel structure. Observation of the direction of rotation of the mass allows the helmsman to determine what direction to steer the vessel so that the vessel remains headed into the waves.

10 Claims, 4 Drawing Figures

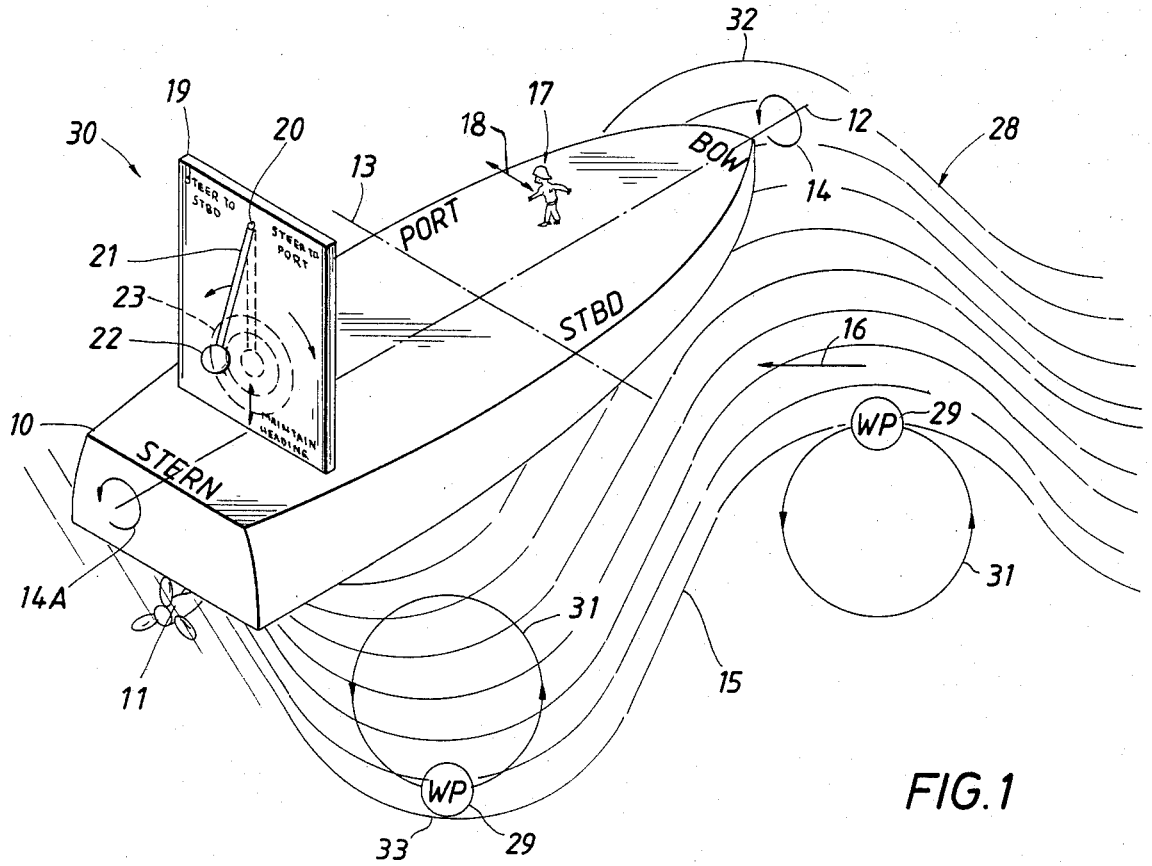
FIG. 1
FIG. 2
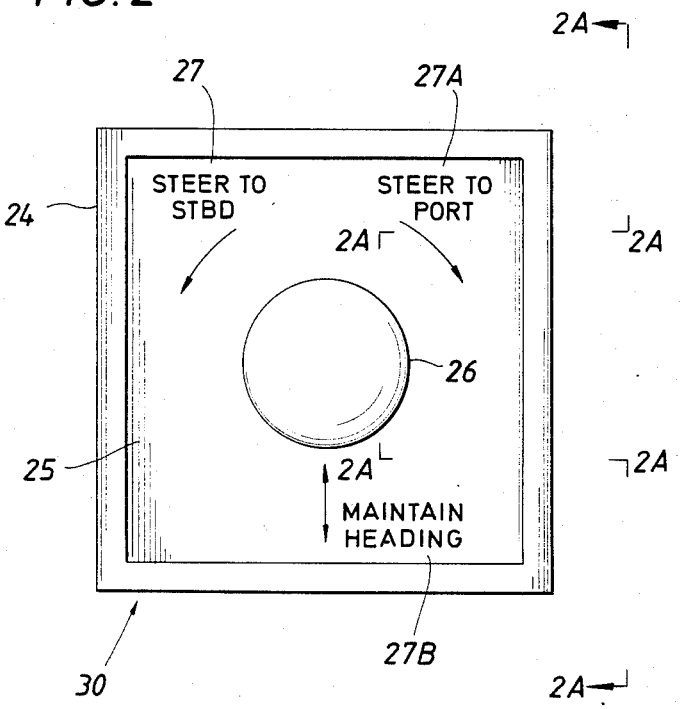
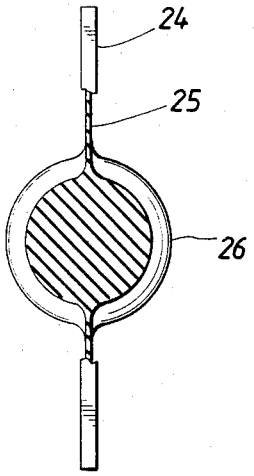
FIG. 2A

SHIP WAVE HEADING INDICATION METHOD AND APPARATUS

BACKGROUND OF THE INVENTION

1. Field of the Invention

This invention relates to a method and apparatus used to position a floating vessel so a to place the bow of the vessel into the direction of approaching waves. Orientation of the vessel in this manner reduces the risk of the vessel capsizing, reduces discomfort, fatigue, and risk of injury to the crew, and reduces the wave drift forces tending to move the vessel off location if the vessel is moored with multiple anchors or by dynamic positioning.

2. Description of the Prior Art

In a storm when waves become high enough even large ships must turn the bow into oncoming waves to reduce the risk of damage and the possibility of capsizing. This is true of ships traveling at sea from one point to another. It is also true with ships moored on a location such as drill ships, because with drill ships it is important even in lower sea states to point into the waves to reduce lateral movements of the ship which cause much discomfort, fatigue, and hazard to the crew involved in the drilling operation.

Waves that impact a ship at any angle except directly on the bow or stern cause lateral components of acceleration and vessel motion from yaw, sway, and roll. This lateral motion makes manual work most difficult; one must brace themselves strongly and move with the ship or walk from side to side to stay upright. Objects that are tied down strain their lashings and slide or roll and become dangerous if they break free. This lateral motion hampers crew operations, especially on vessels where manual labor must continue during adverse weather conditions, such as on offshore drilling vessels positioned over subsea wellheads. While various position control systems may be employed to maintain one of these drilling vessels over a subsea wellhead, such as the system described in U.S. Pat. No. 3,145,683, by H. L. Shatto, Jr. and R. H. Kolb entitled SHIP CONTROL SYSTEM, filed Aug. 22, 1961, Ser. No. 133,119, no means are provided to change the vessel heading to compensate for change in wave direction. It becomes very difficult at night or other times of poor visibility to tell which direction the waves that most affect the ship are coming from. An apparatus needs to be developed to allow a vessel's crew to determine which direction the vessel should be turned to in order to reduce lateral motions, and to minimize the risk of capsize of the vessel.

SUMMARY OF THE INVENTION

The present invention is directed to observation of a mass elastically suspended from a vessel's structure. The mass and spring support should be chosen to have natural periods for both vertical and lateral movement in the same order of magnitude. The value of spring and mass for either of these movements can be tuned closer to the period of the most significant response of the ship in that direction in order to increase the amplitude of motion of the mass with respect to that of the ship.

To understand the operation of the suspended mass it must be first understood that water particles in a wave move in a roughly circular or elliptical orbit. The circle or ellipse is in a vertical plane which contains the line of the direction of the wave movement. The top of the circle moves in the direction of the wave crest and the bottom of the circle or wave trough in the opposite direction. This orbital motion of the wave particles is imparted to a ship and its contents located in the path of the waves. Orbital motion is therefore also imparted to the elastically suspended mass of the present invention.

If the suspended mass located on the ship or vessel is free to move in three dimensions, the orbit of the mass with respect to the ship will be similar to the orbital motion of the ship, which substantially coincides with the orbital motion of the wave particles. The suspended mass will therefore tend to lie in a vertical plane with motion at the top of the orbit approximately in the direction of wave movement.

Because ships are built with little drag fore and aft, acceleration forces in surge tend to be relatively small. Also, since we primarily want to know which way to turn the ship to put the bow or stern into the waves, the motion of the mass is typically constrained within a fixed plane defined perpendicular to the longitudinal axis of the vessel.

In further consideration of the operation of the suspended mass, it must be realized that if the waves impact the vessel's starboard side at any angle except strait on the bow or stern, then the ship will move in a series of counter-clockwise orbits when viewed from aft to forward.

Alternatively, if the waves impact the port side then the ship will move in a series of clockwise orbits when viewed from aft to forward. The vessel's orbital motions are accentuated toward either the bow or stern when in quartering seas because of the additive effect of yaw and pitch. In this case, the motion of the bow and stern can be almost 180° out of phase with each other, but both will be moving clockwise due to waves from port and counter-clockwise due to waves which impact the vessel from starboard.

In operation, since the vessel will move counter-clockwise about its longitudinal axis when waves cyclically impact the starboard side, the mass will be observed rotating counter-clockwise also. After visual observation of this counter-clockwise rotation the vessel heading may be changed to starboard. When the vessel heading has been changed to starboard sufficiently such that the vessel now is heading directly into the waves, the vessel will move up and down but will not rotate orbitally to port or starboard. The observed movement of the mass will now be upward and downward, and the vessel will be maintained at the heading where the mass continues the upward and downward movement.

The same process is followed when waves impact the port side of the vessel, except that the vessel initially rotates clockwise about the longitudinal axis, and the vessel is turned to port when clockwise rotation of the mass is observed.

Accordingly, it is an object of the present invention to provide a floating vessel with a ship/wave heading indicator that allows the vessel to be steered into oncoming waves, and also indicates the direction of wave movement.

A further object of the invention is to provide a ship/wave heading indication apparatus which is simple in design, rugged in construction, and economical to manufacture.

The various features of novelty which characterize the invention are pointed out with particularity in the claims next to and forming a part of this disclosure. For a better understanding of the invention, its operating advantages and specific object obtained by its uses, reference should be made to the accompanying drawing and descriptive matter in which there are illustrated preferred embodiments of the invention.

BRIEF DESCRIPTION OF THE DRAWING

FIG. 1 is a schematic representation of a floating vessel subject to wave from the starboard quarter.

FIGS. 2 and 2A are schematic representation of a ship/wave heading indication apparatus.

DESCRIPTION OF THE PREFERRED EMBODIMENT

Figure 3:
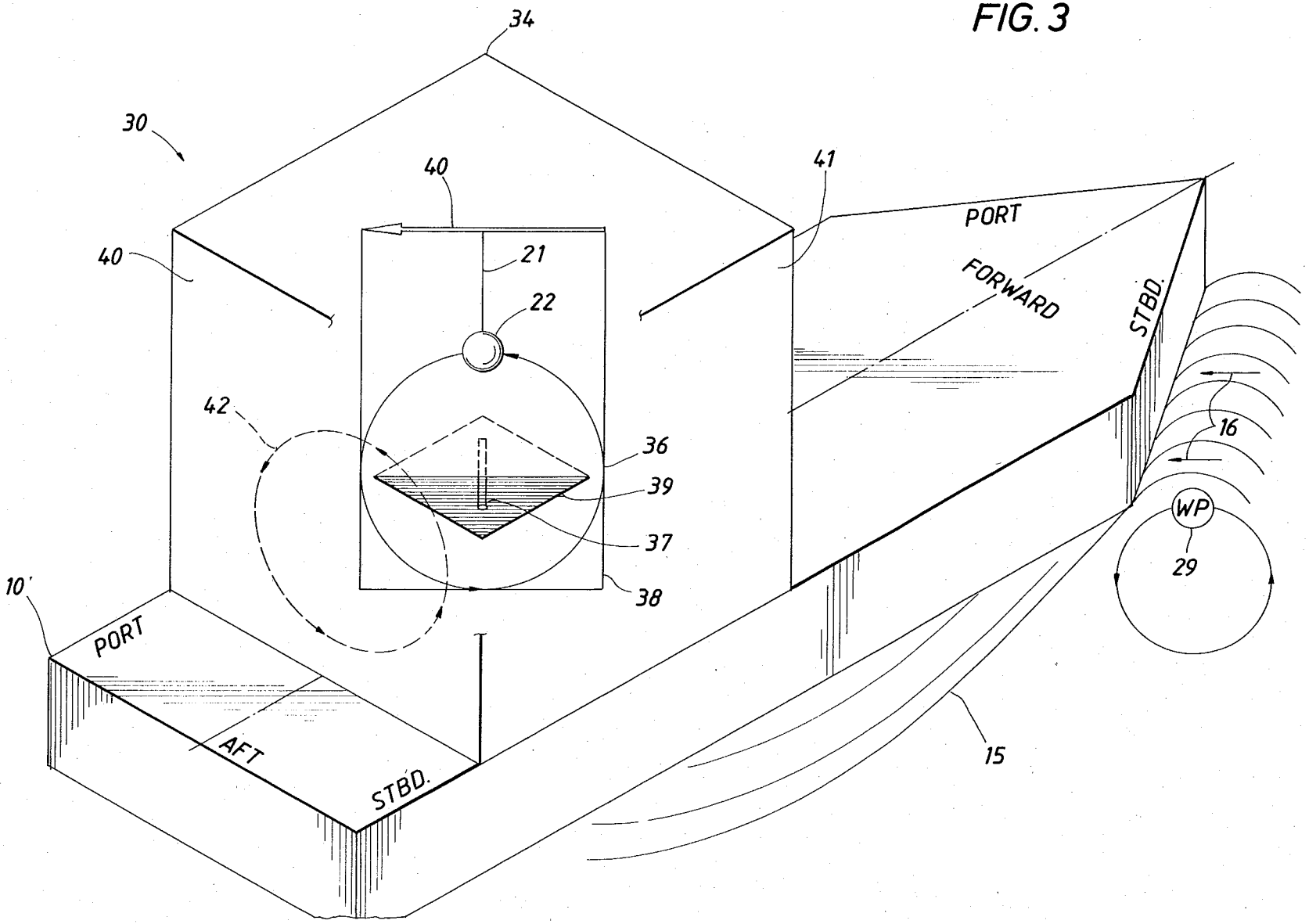
FIG. 3 is a schematic representation of a ship/wave heading indication apparatus that provides wave direction indication.

As shown in FIG. 1, a vessel 10 having a longitudinal axis 12 and a transverse axis B is floating in a body of water 28. The vessel 10 has two ends, one of the ends defining a bow section shown facing into wave 15, and a port (left) and starboard (right) side, well known to the art. The body of water 28 has a series of waves 15 which move in the direction shown by wave direction arrow 16. A water particle 29 located in wave 15 moves in a roughly circular orbit. The path of movement of the water particle 29 is defined by a circle or ellipse 31 located in a vertical plane which is aligned with wave direction arrow 16. When the water particle 29 is at the crest 32 of a wave 15, the particle 29 will move in the direction of movement of the wave 15 crest 32, coinciding with wave direction arrow 16. Alternatively, the water particle 29 will move in a direction opposite wave direction arrow 16 when in the trough 33 of a wave 15. The orbital motion of all the wave particles 29 forming a wave 15 is imparted to the vessel 10 located in the path of wave 15, causing a corresponding orbital movement of the vessel 10 and all of the vessel's 10 contents.

The waves 15 which impact the vessel 10 on the starboard quarter of the bow section cause the vessel 10 to move in a counter-clockwise orbit. The direction of this rotation is shown by the arrows 14, 14A. Alternatively, waves 15 which approach the vessel 10 from the port quarter cause the vessel 10 to orbit clockwise. Movement of the vessel 10 in this manner subjects a worker 17 to hazards, fatigue, and discomfort. The vertical component of this movement is the least damaging since it only tends to increase or decrease the subject's weight as he stand o the deck of the vessel 10. The horizontal component of these accelerative forces, however, (indicated by the arrow 18) causes significant operational problems since the effect is to move the deck under personnel and equipment.

The accelerative forces associated with these movements, may be utilized to advantage by the apparatus of the present invention, the ship/wave heading indication apparatus 30 shown located near the stern of the vessel 10.

In a preferred embodiment, an elastic member 21, such a rubber band well known to the art, is connected to an attachment post 20, the elastic member 21 supporting mass 22, such as a large washer or nut well known to the art. As acceleration due to the vessel's orbital movements is imparted to the mass 22, the mass 22 will tend to orbit in various circles indicated by the paths of possible rotation 23, in this case shown as dotted lines on an indicator plate 19, such as flat board or bulkhead which is mounted behind the mass 22. In a preferred embodiment, the plate 19 is positioned within plane formed perpendicular to the longitudinal axis 12 of the vessel 10. It is recognized that this indicator plate 19 eases the interpretation of the direction of the mass's 22 rotation, though it is not necessary for this plate 19 to be included for the invention to operate properly.

The counter-clockwise rotation of the mass 22 can be observed and matched with the instructions on the indicator plate 19. In this case, the helmsman (not shown) is advised to steer the vessel 10 to starboard by actuation of selective portions of the vessel's 10 steering and propulsion means 11, such as an engine, propeller and rudder assembly well known to the art. As the vessel 10 is turned to face into the direction 16 of the waves 15, the orbital movement of the vessel 10 no longer has a port or starboard component, and the mass 22 will cycle upward and downward only. Matching this upward and downward movement with the instructions on the indicator plate 19 should cause the helmsman to maintain the vessel 10 parallel to the wave direction 16. As can be imagined, waves 15 which impact the vessel 10 from the port quarter will cause the mass 22 to orbit in clockwise direction, which should cause the helmsman to steer the vessel 10, after reading the instructions on the indicator plate 19, to the port direction.

The ship's wave direction indicator 30 can be installed at almost any suitable location such as the bridge (not shown) or the dynamic positioning room (not shown), however, the vessel's 10 motions and indicator response will be larger the farther the heading indication apparatus 30 is removed from the vessel's 10 center toward either the bow or stern.

As shown in FIG. 2, a preferred embodiment may take the form of a mounting frame 24 which hold an elastic member such as a thin elastic membrane 25 which gradually increases in thickness to form an elastic membrane mass 26 located in the approximate center of the mounting frame 24. In other words, an elastic material, such as rubber, may be used not only to supply the elastic stretchability required to allow movement of the mass 22, but the elastic material may also be used to form the mass 22 itself. In this embodiment, the appropriate instructions are formed directly on the elastic membrane 25 by stamped lettering and arrows 27, 27A, 27B. FIG. 2A shows the general shape of the elastic membrane mass 26 of this alternative embodiment. It is recognized that many other systems and configurations may be used to accomplish the same mechanical result.

In an alternative embodiment of the ship wave heading apparatus 30 shown in FIGS. 1 and 2 a viewing box 34 is shown in FIG. 3 carried by vessel 10. The box 34 may have sides constructed of plexiglass or other transparent material well known to art. Elastic member means 21 are operatively suspended from the top of the box 34. It is understood that elastic member means 21 may be suspended from any portion of the vessel 10 for the apparatus 30 to operate properly. A mass 22 is suspended from the elastic member means.

Wave particles 29 which impact the vessel 10 impart an orbital motion to mass 22, as discussed earlier. Since the mass 22 is not restrained by an indicator plate 19 (FIG. 1) the mass 22 may now more accurately exhibit the direction of the wave particles 29, and hence the direction of the waves 15, indicated by arrows 16.

The mass 22 will move in an elliptical manner about a central axis of rotation 37, due to the mass's 22 orbital movements. The central axis 37 is defined perpendicular to the plane 38 passing through the path of movement 36 of the mass 22.

To determine the direction that waves 15 impact the vessel 10, the mass 22 may be viewed relative to a horizontal plane 39 defined through the central axis 37, or more simply, the mass 22 may be viewed "from the top." The visually observed direction of movement of the mass 22 as the mass 22 travels upward through the horizontal plane 39 and subsequently downward through the plane 39 is indicated by wave direction arrow 40. The arrow 40 as drawn indicates that waves 15 currently impact the vessel 10 on the forward starboard quarter. Note that the mass 22 is seen to move in the same manner as wave particle 29. Alternatively, if waves 15 impact the vessel 10 from the port aft quarter, the visually observed direction of movement of the mass 22 will be approximately opposite that shown by arrow 40.

If the mass 22 is observed through aft viewing plane 40, counter-clockwise movement 42 of the mass 22 will be observed, an indication utilized by the apparatus 30 of FIG. 1 to advise the helmsman which direction to steer the vessel 10 to face the vessel 10 into the direction 16 of the waves 15.

If the mass 22 is viewed through side viewing plane 41, an observer can visually determine if waves 15 currently impact the vessel 10 from the bow section or the stern section. If from the bow section, the mass 22 will be observed rotating counter-clockwise. Alternatively, if waves impact the vessel's 10 stern section, the mass 22 will be observed rotating clockwise.

The viewing box 34 may be imprinted with information (not shown) to aide in the interpretation of the mass 22 movement. As can be seen in FIG. 3, the viewing box 34 embodiment of the present invention can not only advise the helmsman what direction to steer the vessel 10, but the box 34 can also indicate the current wave 15 direction and whether the waves 15 currently impact the bow or stern portions of the vessel.

Many other variations and modifications may be made in the apparatus and techniques hereinbefore described, both by those having experience in this technology, without departing from the concept of the present invention. Accordingly, it should be clearly understood that the apparatus and methods depicted and the accompanying drawing referred to in the foregoing description are illustrative only and are not intended as limitations on the scope of the invention.

I claim as my invention:

1. Ship wave heading indication apparatus for use on a floating vessel subjected to wave impact, said vessel having a longitudinal axis and a transverse axis and two ends, one of said ends defining a bow section of said vessel, said vessel having vessel heading change means such as a propulsion and steering system, said vessel heading indication apparatus used to indicate the direction of wave impact and the proper direction to turn the vessel in order to align the bow section into the direction of wave impact, said apparatus comprising:

at least one elastic member means operatively secured to said vessel at a location relative to said transverse axis of said vessel, and an observable mass suspended from said elastic member means, said apparatus located within an inhabitable interior compartment of said vessel.

2. The apparatus of claim 1 wherein said elastic member means further comprises rubber membrane means mounted perpendicular to the longitudinal axis of said vessel.

3. The apparatus of claim 1 wherein said elastic member means further comprises rubber band means.

4. A method of determining the heading required for a floating vessel, said vessel having a longitudinal axis and a transverse axis and two ends, one of said ends defining a bow section of said vessel, said vessel subjected to wave impact, said vessel having vessel heading change means such as a propulsion and steering system, to cause alignment of the longitudinal axis of said vessel parallel to the existing wave direction, said method comprising:

providing an elastic member means suspended from a portion of the vessel at a location relative to said transverse axis of said vessel, providing a mass suspended from said elastic member means, said mass and said elastic member means located within an inhabitable interior compartment of said vessel, observing any orbital motion of the mass, relative to a plane formed perpendicular to the longitudinal axis of the vessel, and altering the heading of the vessel by actuating at least a portion of the vessel heading change means of the vessel, to eliminate the orbital motion of the mass relative to said plane formed perpendicular to the longitudinal axis of said vessel.

5. The method of claim 4 wherein the step of altering the heading of the vessel further includes the step of steering said vessel to starboard, when counter-clockwise orbital motion of said mass is observed, where said mass is located between an observer and said bow section of said vessel.

6. The method of claim 4 wherein the step of altering the heading of the vessel further includes the steps of turning said vessel to port, if clockwise orbital motion of said mass is observed, where said mass is located between an observer and said bow section of said vessel.

7. A method of determining the direction of waves which impact a vessel having a longitudinal axis and a transverse axis, comprising:

providing an elastic member means operatively suspended from a portion of said vessel, at a location relative to the transverse axis of said vessel, providing an observable mass suspended from said elastic member means, said mass and said elastic member means located within an inhabitable interior compartment of said vessel, said mass moving about a central axis of rotation defined perpendicular to a plane passing through the path of movement of said mass, said path forming an ellipse due to the orbital movement of said mass about said central axis of rotation, and observing an indication of the direction of said waves which impact said vessel by viewing the direction of movement of said mass as said mass passes upward and thereafter downward through a horizontal plane defined through said central axis.

8. A method of determining the initial point of wave impact on a vessel having two ends defining a bow section and stern section of said vessel and a longitudinal axis defined along the length of said vessel and a transverse axis, said method comprising:

providing an elastic member means suspended from a portion of said vessel at a location relative to said transverse axis, providing an observable mass suspended from said elastic member means, said mass and said elastic member means located within an inhabitable interior compartment of said vessel, and observing any orbital motion of said mass, relative to a vertical plane formed parallel to the longitudinal axis of said vessel, said observation made in a starboard to port direction, clockwise motion of said mass indicating that said waves initially impact the stern section of said vessel counterclockwise motion of said mass indicating that said waves initially impact said bow section of said vessel.

9. Ship wave heading indication apparatus for use on a floating vessel subjected to wave impact, said vessel having a longitudinal axis and two ends, said ship wave heading indication apparatus used to indicate the proper direction to turn the vessel in order to align one of said ends into the direction of wave impact, said apparatus comprising:

an indicator plate positioned within a plane formed perpendicular to the longitudinal axis of the vessel, said indicator plate located within an inhabitable interior compartment of said vessel, an attachment post having a first end and a second end, said first end operatively connected to said indicator plate, an elastic member having a first end and a second end, said second end of said elastic member operatively connected to said second end of said attachment post, and an observable mass suspended from said first end of said elastic member, said mass capable of orbital motion due to flexure of said elastic member as a result of accelerative forces imparted to said mass from wave impact upon said vessel.

10. Ship wave heading indication apparatus for use on a floating vessel subjected to wave impact, said vessel having a longitudinal axis and two ends, said ship wave heading indication apparatus used to indicate the proper direction to turn the vessel in order to align one of said ends into the direction of wave impact, said apparatus comprising:

a mounting frame positioned within a plane formed perpendicular to the longitudinal axis of the vessel, said frame being located within an inhabitable interior compartment of said vessel, and an elastic membrane mounted within said mounting frame, said elastic membrane having a relatively thin cross section defined adjacent said mounting frame, said cross section increasing in thickness towards the center of said membrane so as to form an elastic membrane mass located in the approximate center of said elastic membrane, said mass capable of orbital motion due to flexure of the edge of said elastic membrane as a result of the accelerative forced imparted to said mass from wave impact upon said vessel.

* * * * *